United States Patent [19]

Grabau

[11] 4,165,142

[45] Aug. 21, 1979

[54] CONNECTOR CLIP

[75] Inventor: Edwin W. Grabau, Point Pleasant, N.J.

[73] Assignee: Bell Telephone Laboratories, Incorporated, Murray Hill, N.J.

[21] Appl. No.: 906,934

[22] Filed: May 18, 1978

[51] Int. Cl.[2] ..... H01R 13/54

[52] U.S. Cl. ..... 339/75 R; 174/138 G; 248/500; 339/91 R

[58] Field of Search ..... 174/138 G; 248/154, 248/316 D, 201, 500, 507, 508, 509, 510; 339/75 R, 75 M, 75 P, 91 R, 103 R, 104, 120

[56] References Cited

U.S. PATENT DOCUMENTS

| | | | |
|---|---|---|---|
| 1,989,823 | 2/1935 | Raabe | 339/75 P |
| 2,869,098 | 1/1959 | Sauer | 339/91 R X |
| 3,233,856 | 2/1966 | Ammerman | 248/229 |
| 3,564,485 | 2/1971 | Cull et al. | 339/198 |
| 4,043,627 | 8/1977 | Ayer | 339/75 R |
| 4,099,819 | 7/1978 | Keglewitsch | 339/75 M |
| 4,121,880 | 10/1978 | Rollins et al. | 339/75 M X |

FOREIGN PATENT DOCUMENTS

| | | | |
|---|---|---|---|
| 729567 | 5/1955 | United Kingdom | 248/500 |

*Primary Examiner*—E. F. Desmond
*Attorney, Agent, or Firm*—David H. Tannenbaum

[57] ABSTRACT

There is disclosed a clip for securing in mated relationship two-part connectors where one connector part is mounted to a panel. The clip is designed having an upper section which curves to fit over the top of the mated connector housing. The lower section of the clip, which is hinged to the upper section, contains a pair of tabs extending from the side edges. The tabs are folded backward to form slots which operate to hold the clip secure against the panel. The hinge is arranged to provide an additional slot so that the clip can secure connectors having differing heights.

4 Claims, 5 Drawing Figures

CONNECTOR CLIP

TECHNICAL FIELD

This invention relates to a retaining clip for use with multipart connectors and more particularly to a hinged retaining clip for maintaining the connectors in mated relationship.

BACKGROUND

It has become common practice to mount one part of a multipart electrical connector to a mounting panel and to detachably mate a second part of the connector with the first part. When the two parts are mated it is usually desired that they remain together for long periods of time under varying environmental situations. To accomplish such a result reliance is usually made upon the combined insertion-extraction forces of the individual electrical contacts of the connectors. However, in some applications it is desired to use a positive locking force to insure that the two parts of the connector remain mated until manually released.

To compound the problem several other considerations must be considered. In actual practice it is desired to mount the connectors in close proximity to each other and thus bulky locking arrangements are not acceptable. A second consideration is that the cable hoods of the various connectors have at least two differing heights. When it is desired to interchange connectors having different size hoods the locking mechanism must be arranged to accept the different size with a minimum of effort and, if possible, without requiring removal of the permanently mounted connector portion. Still a third constraint is that the locking mechanism must be inexpensive to manufacture.

DISCLOSURE OF THE INVENTION

These and other objects and problems are solved by a retaining clip having a curved upper section for locking around the removable connector. The clip has a slotted lower section for attachment to the mounting panel. The slots are constructed by rolling the ends of the lower section inward to provide support for the clip in cooperation with the mounting panel. Two sets of slots are provided so that the clip may be raised or lowered for use with high or low connector housings.

The clip is designed such that by using a cutout in the mounting panel, if so desired, the clip can be slipped into the panel after the fixed portion of the connector is securely in place. The clip then may be raised or lowered without removing the connector from the panel.

DESCRIPTION OF THE DRAWING

The construction and utilization of the present invention will be more apparent from the following description, taken in conjunction with the drawing, in which.

DETAILED DESCRIPTION

Figure 1:
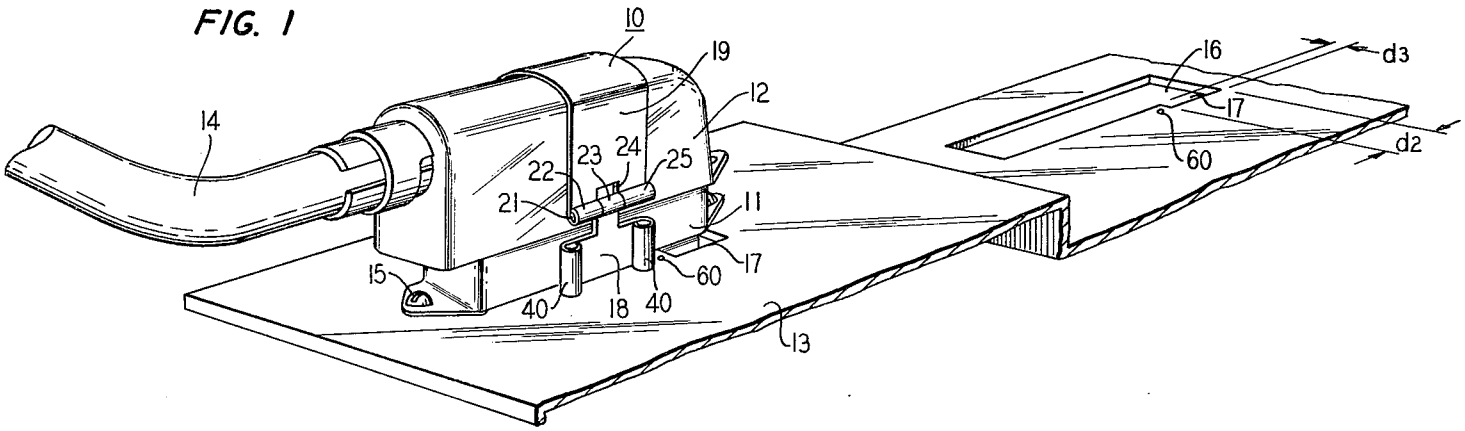
FIG. 1 shows a mated connector being restrained by a retaining clip.

In FIG. 1 there is shown a two-part connector having a first part 11 and a second part 12 mated together with part 11 affixed to panel 13 in a cutout, such as cutout 16. Electrical cable 14 is shown extending from the hood portion of part 12 of the connector. The multipart connector is of a type well known in the art such as, for example, the series 57 microribbon connectors manufactured by Amphenol Incorporated.

The individual wires of cable 14 terminate in pins (or sockets) inside part 12 of the connector. These pins mate on an individual basis with sockets (or pins) mounted in part 11 of the connector. Part 11 of the connector is attached to panel 13 by screws, rivets or other mounting devices 15.

Retaining clip 10 is shown locked around the mated multipart connector and serves to maintain connector part 12 together with connector part 11. In order to remove connector part 12 it is first necessary to push back retaining clip 10, which pivots around pin 21.

Figure 3:
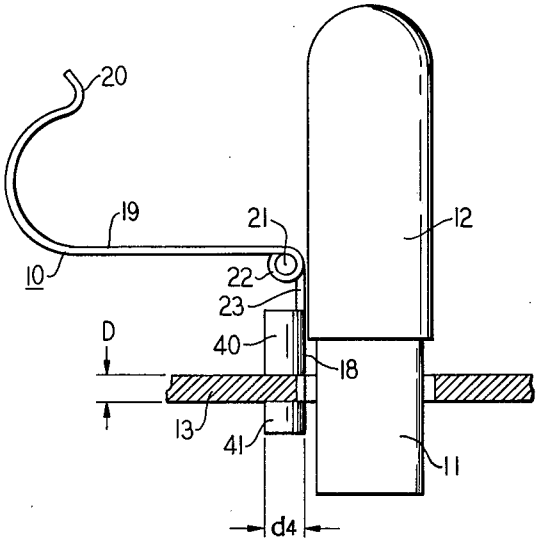
FIG. 3 shows a side view of a retaining clip opened for release of a connector.

A typical cutout 16 is shown having cutout area 17 in which retaining clip 10 may be slipped in or out even while connector portion 11 is mounted in place. Such a cutout is not necessary when the retaining clip is to be used with a single size connector or when it is desired to remove the fixed portion of the connector to change the height of the connector clip, providing that retaining clip 10 is positioned in slot 16 before affixing connector portion 11. The width of slot 17 (d2) is slightly larger than the width (d1) of lower portion 18 of retainer clip 10. The depth (d3) of slot 17 is slightly larger than the thickness (d4) of retainer clip 10 as shown in FIG. 3.

Note that, as shown in FIG. 1, when retaining clip 10 is in position a screw or other retaining device may be inserted in hole 60 thereby preventing retainer clip 10 from sliding out through slot 17.

Figure 2:
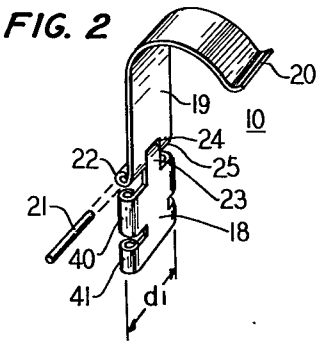
FIG. 2 shows a partially exploded view of the retaining clip.

Turning now to FIG. 2 it will be seen that retaining clip 10 is constructed advantageously from spring metal or other resilient material having an upper section 19 and a lower section 18. Upper section 19 has a curved upper end the inside of which curve being designed to fit snugly over the top of a mated connector in the manner shown in FIGS. 4 and 5. At the end of the curved section an outward bend 20 is formed for the purpose of allowing pressure to be applied in an outward and upward manner to release the retaining clip. At the lower end of section 19 a center slot 24 is formed leaving two downwardly projecting fingers 22 and 25 of material. These fingers are rolled backward in a direction opposite the curved upper section to form a pair of closed tubular cylinders the inside diameter of which is designed to accept rod 21. These tubular passages are lined axially with each other across the lateral face of section 19.

Lower section 18 is formed with slots in each side, these slots formed between outwardly extending fingers 40 and 41. These fingers are rolled or folded inward forming support structures the bottom and top surfaces of which are designed to bear against mounting panel 13 in the manner shown in FIGS. 3, 4 and 5.

At the upper edge of section 18 on the center line thereof an upwardly extending finger 23 is constructed having a width slightly smaller than the width of slot 24 in the lower edge of section 19. Finger 23 is rolled in the same direction as are rolls 40 and 41 to form a tubular passage the inside diameter of which accepts rod 21. When assembled, finger 23 slips into slot 24 and rod 21 fits snugly into the tubular passages of fingers 22, 23 and 25 (as shown in FIG. 2) such that section 19 is free to rotate with respect to section 18, this rotation being controlled by hinge assembly 22, 23 and 25 rotating around rod 21.

Figure 5:
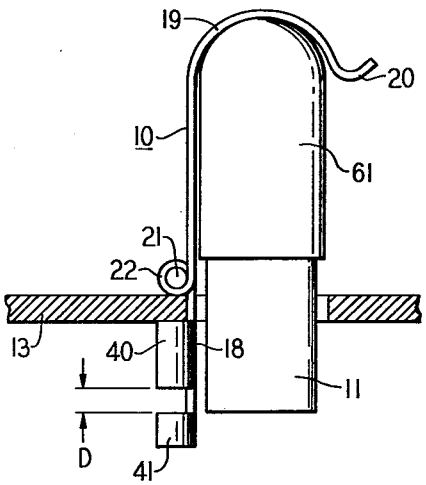
FIGS. 4 and 5 show a side view of a retaining clip locked against connectors of different sizes.
Figure 4:
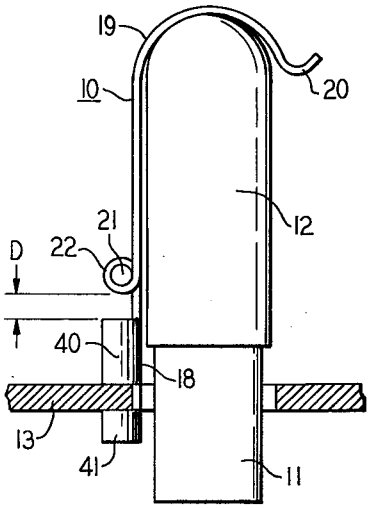

As shown in FIGS. 3, 4 and 5 the slot in lower section 18 between fingers 40 and 41 is designed having a width D to perfectly mate with the thickness D of panel 13. Thus the bottom surface of formed tube 40 rests securely on the top surface of panel 13 while the top surface of formed tube 41 rests on the bottom surface of panel 13 as shown in FIGS. 3 and 4. Advantageously, the areas of contact at each of these surfaces would be 4.374 square millimeters.

A second slot is formed between the lower surface of the hinge assembly (22, 23 and 25) and the top surface of tube 40. The width of this slot, as shown in FIG. 4, is also constructed to have a value D, which is the thickness of panel 13.

In FIG. 3 connector clip 10 is shown opened and away from housing 12 thereby allowing housing 12 to be removed from fixed connector portion 11.

In FIG. 4 retaining clip 10 is shown in a locked position such that the curved portion of section 19 is extended snugly over the top of and in mating relationship with connector portion 12. Retaining clip 10 remains in this position until upwardly applied force is exerted at lip 20.

In FIG. 5 a connector hood 61 is shown having a reduced size from that shown in FIG. 4. In such a situation retaining clip 10 is lowered in the manner previously discussed such that the upper surface of formed tube 40 bears against the lower surface of panel 13 while the lower lateral surface of formed tube 22 bears against the upper surface of panel 13 thereby holding retaining clip 10 in proper position.

Since each slot is constructed having at least two widely spaced bearing surfaces a high degree of stability is achieved. Of course, while the fingers are shown with tubular passages it is understood that any manner of manufacture, including molding, bending and rolling, can be used to achieve the desired result.

What is claimed is:

1. A clip for securing in mated relationship a two-part connector having a first part mounted to a panel and a second part adapted for mating with said first part, characterized in that said clip comprises a first section having a lateral surface and a curved upper section folding forward over said lateral surface and shaped generally to extend over a top surface of a mated connector, said first section having a pair of fingers extending from a lower end of said lateral surface and separated by a first space, said fingers each rolled back over said lateral surface in a direction opposite the direction of said curved upper section, each said rolled finger forming an enclosed tubular passage, a second section having a lateral surface and a pair of tabs extending outward from each side of said lateral surface, said tabs curved back toward said lateral surface, said pair of tabs on each side of said lateral surface forming a first slot between them having a width adapted to accept said panel therebetween, said second section having a finger extending from a top edge of said lateral surface and disposed evenly about the center thereof, said finger rolled back on the same side of said second section lateral surface as are said other tabs of said second section, said second section rolled finger forming an enclosed tubular passage having a width adapted to fit within said first space between said first section enclosed tubular passages, a pin extending through said first section enclosed tubular passages and said second section enclosed tubular passage thereby joining said first and second sections in hinged relationship with each other, said pair of tabs of each side of said second section having an upper and a lower surface, said lower surface of the top tab on each side of said second section defining the top edge of said second section slot and said upper surface of the bottom tab on each side of said second section defining the lower edge of said second section slot, said lower edges of said upper tabs and said upper edges of said lower tabs forming bearing surfaces for supporting said retaining clip with respect to a panel inserted within said first slot.

2. The invention set forth in claim 1 wherein the distance from said lower edge of said upper second section tabs to the top of said first section curved portion is approximately equal to a first height of a mated connector.

3. The invention set forth in claim 2 wherein said pair of tubular passages of said first section have a lower surface along a lateral edge thereof, said tubular passage of said second section being arranged at the top end of said second section finger, said finger having a height above the top lateral edge of said second section such that when said pin is inserted through said enclosed tubular passages of said first and second sections the distance between said lower edge of said first section tubular passages and said upper edge of said upper pair of second section tabs define a second slot having a width equal to the width of said first slot, said lower edge of said first section tubular passages and said upper surface of said second section upper pair tabs forming bearing surfaces for supporting said retaining clip with respect to a panel inserted within said second slot.

4. The invention set forth in claim 3 wherein the distance from said lower edge of said first section tubular passages to the top of said first section curved portion is approximately equal to a second height of a mated connector, said second height being less than said first height.

* * * * *